US009041644B2

(12) United States Patent
Hsiao et al.

(10) Patent No.: US 9,041,644 B2
(45) Date of Patent: May 26, 2015

(54) ELECTRO-PHORETIC DISPLAY AND DISPLAY METHOD THEREOF

(71) Applicants: Chia-chiang Hsiao, Guangdong (CN); Chih-Wen Chen, Guangdong (CN)

(72) Inventors: Chia-chiang Hsiao, Guangdong (CN); Chih-Wen Chen, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 134 days.

(21) Appl. No.: 13/704,160

(22) PCT Filed: Nov. 15, 2012

(86) PCT No.: PCT/CN2012/084651

§ 371 (c)(1),
(2) Date: Dec. 13, 2012

(87) PCT Pub. No.: WO2014/075254

PCT Pub. Date: May 22, 2014

(65) Prior Publication Data

US 2014/0132496 A1 May 15, 2014

(30) Foreign Application Priority Data

Nov. 14, 2012 (CN) ..... 2012 1 0455612

(51) Int. Cl.
*G09G 3/34* (2006.01)
*G09G 3/20* (2006.01)

(52) U.S. Cl.
CPC ..... *G09G 3/344* (2013.01); *G09G 3/2003* (2013.01)

(58) Field of Classification Search
CPC ..... G09G 3/344–3/3446
USPC ..... 345/107
See application file for complete search history.

(56) References Cited

U.S. PATENT DOCUMENTS

2010/0177074 A1* 7/2010 Saito et al. ..... 345/206
2010/0328758 A1 12/2010 Sikharulidze et al.
2011/0026099 A1 2/2011 Kwon et al.
2011/0216055 A1 9/2011 Chiu et al.

(Continued)

FOREIGN PATENT DOCUMENTS

CN 101960375 A 1/2011
CN 101989023 A 3/2011

(Continued)

*Primary Examiner* — Michael Pervan
(74) *Attorney, Agent, or Firm* — Kirton McConkie; Evan R. Witt

(57) ABSTRACT

The present invention discloses an electro-phoretic display and display method thereof. The method comprises: To form a first electric field so that reflective particles in electro-phoretic layer in an area corresponding to a color resist for display have a first distance from the color substrate. Light incident to the reflective particles partly or completely emerges from the electro-phoretic layer after being reflected by them when the distance is the first distance. To form at least one second electric field in an area corresponding to color resists not for display so that the reflective particles in the electro-phoretic layer in that area have a second distance from the color substrate. Light incident into the electro-phoretic layer is absorbed by the light absorbing liquid when the distance is the second distance. The color resist for display is the one used for displaying a color intended to be displayed by the electro-phoretic display.

10 Claims, 5 Drawing Sheets

(56) References Cited

U.S. PATENT DOCUMENTS

2011/0310130 A1* 12/2011 Nagano ..... 345/690
2014/0132496 A1* 5/2014 Hsiao et al. ..... 345/107

FOREIGN PATENT DOCUMENTS

CN 102193291 A 9/2011
JP 2008107752 A 5/2008

* cited by examiner

ELECTRO-PHORETIC DISPLAY AND DISPLAY METHOD THEREOF

BACKGROUND OF THE INVENTION

1. Field of the Invention

The present invention relates to a display technology, more particularly, to an electro-phoretic display and display method thereof.

2. Description of the Related Art

With the continuous development of display technologies, the demand for performance of various display apparatus is more and more.

Take the electro-phoretic display as an example. Please refer to FIG. 1, FIG. 1 is a schematic diagram showing a structure of a conventional color electro-phoretic display.

The color electro-phoretic display comprises a color substrate 11 and a switch array substrate 12 along a direction of incident light A'. The switch array substrate 12 comprises a first substrate 121, an electro-phoretic layer 122, and a second substrate 123. The electro-phoretic layer 122 is disposed between the first substrate 121 and the second substrate 123. The electro-phoretic layer 122 is filled with black electro-phoretic liquid, and the black electro-phoretic liquid comprises white positive electric charges. A common electrode 1211 is disposed on the first substrate 121. A plurality of pixel electrodes 1231 are disposed on the second substrate 123. A red color resists R, a green color resists G, a blue color resists B, and a white color resists W are disposed on the color substrate 11.

Specifically, different voltages can be applied among the pixel electrodes 1231 and the common electrode 1211 so as to form different electric fields. For example, an 8 volt voltage is applied on the common electrode 1211, a 10 volt voltage is applied to the pixel electrode corresponding to the red color resist R, and a 5 volt voltage is applied to the pixel electrodes corresponding to the green color resist G, the blue color resist B, and the white color resist W. Therefore, an electric field directed opposite to the direction A' (directed upward) is formed in the electro-phoretic layer 122 corresponding to the red color resist R, and an electric field directed along the direction A' (directed downward) is formed in the electro-phoretic layer 122 corresponding to the green color resist G, the blue color resist B, and the white color resist W. The upward-directed electric field pushes the white positive electric charges corresponding to the red color resist R upward. The white positive electric charges in this area thus have a higher reflection ratio to allow the electro-phoretic display displaying red color corresponding to the red color resist R. The downward-directed electric field pushes the white positive electric charges corresponding to the green color resist G, the blue color resist B, and the white color resist W downward. The white positive electric charges in this area thus have a lower reflection ratio so that the electro-phoretic display does not display any color corresponding to the green color resist G, blue color resist B, and white color resist W.

Specifically, owing to the existence of lateral electric fields, areas $M_1'$ and $M_2'$ shown in FIG. 1 will be affected. The area $M_1'$ is located in the area corresponding to the green color resist G and next to the area corresponding to the red color resist R. The area $M_2'$ is located in the area corresponding to the white color resist W and next to the area corresponding to the red color resist R. The lateral electric fields will push the white positive electric charges in the areas $M_1'$ and $M_2'$ upward when the white positive electric charges corresponding to the red color resist R are pushed upward. Hence, when the color corresponding to the red color resist R is displayed, portions of the colors corresponding to the green color resist G and portions of white color resist W will be simultaneously displayed. As a result, the color intensity of red color resist R is reduced to deteriorate the display effect.

Since reflective particles (e.g. the white positive electric charges) move to both side areas of the area corresponding to the color resists not for display, the intensity of displayed color is reduced to cause color mess. It is therefore very important to resolve the above-mentioned problem.

SUMMARY OF THE INVENTION

It is an objective of the present invention to provide a display method for an electro-phoretic display to resolve the now existing problem. According to the prior art, since the reflective particles move to both side areas of the area corresponding to the color resists not for display, the intensity of displayed color is reduced to cause color mess.

In order to resolve the above-mentioned problem, the present invention provides a display method for an electro-phoretic display. The display method comprises the following steps:

To provide the electro-phoretic display. The electro-phoretic display sequentially comprises a color substrate and a switch array substrate along a direction of incident light. The switch array substrate comprises a first substrate, a second substrate, and an electro-phoretic layer sandwiched between the first substrate and the second substrate. The color substrate comprises a plurality of color resists. The electro-phoretic layer comprises light absorption liquid and reflective particles.

To form a first electric field so that the reflective particles in the electro-phoretic layer in an area corresponding to the color resist for display have a first distance from the color substrate. Light incident to the reflective particles partly or completely emerges from the electro-phoretic layer after being reflected by the reflective particles when the distance from the color substrate is the first distance.

To form at least one second electric field in an area corresponding to the color resists not for display so that the reflective particles in the electro-phoretic layer in the area corresponding to the color resists not for display have a second distance from the color substrate. Light incident into the electro-phoretic layer will be absorbed by the light absorbing liquid when the distance from the color substrate is the second distance.

The color resist for display is the color resist used for displaying a color intended to be displayed by the electro-phoretic display.

In one aspect of the present invention, the step for forming the first electric field further comprises: forming the first electric field in the area corresponding to the color resist for display.

In another aspect of the present invention, the step for forming the first electric field further comprises: forming the first electric field in the areas corresponding to both the color resist for display and the color resists not for display.

In still another aspect of the present invention, before the first electric field is formed in the area corresponding to the color resist for display the method further comprises the step of: forming a third electric field in the areas corresponding to both the color resist for display and the color resists not for display so that the reflective particles in those areas have the second distance from the color substrate.

In yet another aspect of the present invention, before the third electric field is formed in the areas corresponding to both the color resist for display and the color resists not for display the method further comprises the step of: forming a fourth electric field in the areas corresponding to both the color resist for display and the color resists not for display so that the reflective particles in those areas have the first distance from the color substrate.

In order to resolve the above-mentioned problem, the present invention further provides a display method for an electro-phoretic display. The display method comprises the following steps:

To provide the electro-phoretic display. The electro-phoretic display sequentially comprises a color substrate and an electro-phoretic layer along a direction of incident light. The color substrate comprises a plurality of color resists. The electro-phoretic layer comprises light absorption liquid and reflective particles.

To form a first electric field so that the reflective particles in the electro-phoretic layer in an area corresponding to the color resist for display have a first distance from the color substrate. Light incident to the reflective particles partly or completely emerges from the electro-phoretic layer after being reflected by the reflective particles when the distance from the color substrate is the first distance.

To form at least one second electric field in an area corresponding to the color resists not for display so that the reflective particles in the electro-phoretic layer in the area corresponding to the color resists not for display have a second distance from the color substrate. Light incident into the electro-phoretic layer will be absorbed by the light absorbing liquid when the distance from the color substrate is the second distance.

The color resist for display is the color resist used for displaying a color intended to be displayed by the electro-phoretic display.

In one aspect of the present invention, the step for forming the first electric field further comprises: forming the first electric field in the area corresponding to the color resist for display.

In another aspect of the present invention, the step for forming the first electric field further comprises: forming the first electric field in the areas corresponding to both the color resist for display and the color resists not for display.

In still another aspect of the present invention, before the first electric field is formed in the area corresponding to the color resist for display the method further comprises the step of: forming a third electric field in the areas corresponding to both the color resist for display and the color resists not for display so that the reflective particles in those areas have the second distance from the color substrate.

In yet another aspect of the present invention, before the third electric field is formed in the areas corresponding to both the color resist for display and the color resists not for display the method further comprises the step of: forming a fourth electric field in the areas corresponding to both the color resist for display and the color resists not for display so that the reflective particles in those areas have the first distance from the color substrate.

It is another objective of the present invention to provide an electro-phoretic display to resolve the now existing problem. According to the prior art, since the reflective particles move to both side areas of the area corresponding to the color resists not for display, the intensity of displayed color is reduced to cause color mess.

In order to resolve the above-mentioned problem, the present invention provides an electro-phoretic display. The electro-phoretic display comprises a color:

A color substrate, the color substrate has a plurality of color resists.

An electro-phoretic layer, the electro-phoretic layer comprises light absorption liquid and reflective particles.

An electric field apparatus used for generating a first electric field so that the reflective particles in the electro-phoretic layer in an area corresponding to a color resist for display have a first distance from the color substrate. The electric field apparatus is also used for generating at least one second electric field in an area corresponding to color resists not for display so that the reflective particles in the electro-phoretic layer in the area corresponding to the color resists not for display have a second distance from the color substrate.

The color resist for display is the color resist used for displaying a color intended to be displayed by the electro-phoretic display, Light incident to the reflective particles partly or completely emerges from the electro-phoretic layer after being reflected by the reflective particles when the distance from the color substrate is the first distance. Light is absorbed by the light absorbing liquid in the electro-phoretic layer when the distance from the color substrate is the second distance.

In one aspect of the present invention, the electro-phoretic display further comprises a switch array substrate, the switch array substrate comprises a first substrate and a second substrate, and the electro-phoretic layer is disposed between the first substrate and the second substrate. The electric field apparatus comprises a common electrode and a plurality of pixel electrodes, the common electrode is disposed on the first substrate, and the pixel electrodes are disposed on the second substrate.

In another aspect of the present invention, the electro-phoretic display further comprises a driver, and the driver electrically connects the common electrode and the pixel electrodes.

In still another aspect of the present invention, the light absorption liquid is black liquid, and the reflective particles are white reflective particles.

In yet another aspect of the present invention, the electric field apparatus is further used for generating the first electric field in the area corresponding to the color resist for display, or generating the first electric field in the areas corresponding to both the color resist for display and the color resists not for display.

In contrast to the prior art, the present invention first provides the first electric field to push the reflective particles corresponding to the color resist for display until finally reach to the point having the first distance from the color substrate. Light incident to the reflective particles will be reflected by the reflective particles, and partly or completely emerges from the electro-phoretic layer. Later, at least one second electric field is provided to push the reflective particles corresponding to the color resists not for display until finally reach to the point having the second distance from the color substrate. Consequently, light will be absorbed by the light absorbing liquid in the electro-phoretic layer. Apparently, the present invention prevents the reflective particles from staying in both side areas of the area corresponding to the color resists not for display. As a result, the effects of color display and the display quality are ensured.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
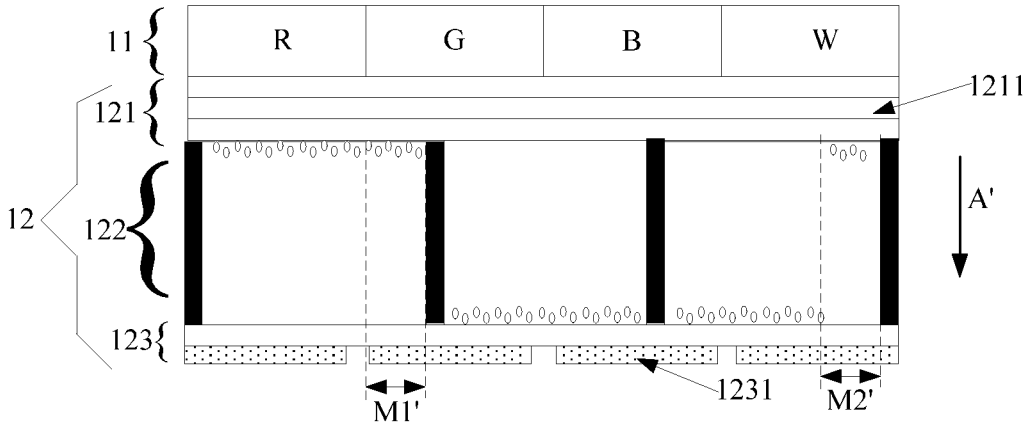
Fig. 1 (Prior art)
FIG. 1 is a schematic diagram showing a structure of a conventional color electro-phoretic display.
Figure 2:
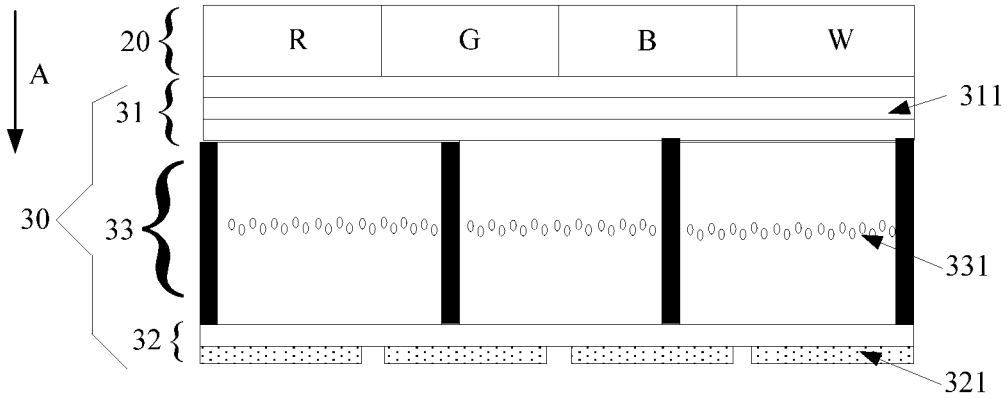
FIG. 2 is a schematic diagram showing a structure of an electro-phoretic display according to a preferred embodiment of the present invention.

Please refer to FIG. 2, FIG. 2 is a schematic diagram showing a structure of an electro-phoretic display according to a preferred embodiment of the present invention. A direction A is a direction of incident light. The electro-phoretic display comprises a color substrate 20 and a switch array substrate 30 along the direction A.

At least two kinds of color resists are disposed on the color substrate 20. For example in FIG. 2, a first color resist R (red color), a second color resist G (green color), a third color resist B (blue color), and a fourth color resist W (white color) are sequentially disposed on the color substrate 20. In another embodiment, the color substrate 20 may comprise a fifth color resist, which is for example a yellow color resist Y and is within the scope of the present invention.

The switch array substrate 30 comprises a first substrate 31, a second substrate 32, and an electro-phoretic layer 33 disposed between the first substrate 31 and the second substrate 32. Light absorbing liquid (not indicated) is injected into the electro-phoretic layer 33. The light absorbing liquid (not indicated) is mixed with reflective particles 331. The light absorbing liquid (not indicated), being preferably black liquid, is able to absorb light. The reflective particles 331 are used for reflecting light, and are preferably white reflective particles. Furthermore, the reflective particles 331 move under the influence of an electric field. For example, the reflective particle 331 is a positively charged reflective particle.

A common electrode 311 is disposed on the first substrate 31. The common electrode 311 is for example a transparent electrode made of indium tin oxide (ITO). A plurality of pixel electrodes 321 are disposed on the second substrate 32. The plurality of pixel electrodes 321 are corresponding to the color resists on the color substrate 20. When there is a voltage difference between the common electrode 311 and the pixel electrode 321, an electric field between them is thus generated. The electric field makes the reflective particles 331 in the electro-phoretic layer 33 move. For example, when the reflective particles 331 are positively charged reflective particles, thy will move along the direction of the electric field.

The electric-phoretic display further comprises a driver (not indicated). The driver is disposed between the first substrate 31 and the second substrate 32, and is preferably disposed at an inner side of the second substrate 32. The driver electrically connects the common electrode 311 and the pixel electrodes 321 for providing the common electrode 311 and the pixel electrodes 321 with voltages. Moreover, the driver may be used for realizing the switching between different display modes of the electric-phoretic display according to customer's choice. For example, the driver may be used for switching between the black and white mode and the color mode.

Under color mode, the driver can flexibly control the voltage applied to each of the pixel electrodes 321. By cooperating with the voltage applied on the common electrode 311, an electric field is generated in each of the corresponding areas. Therefore, reflective particles 331 in different areas will be pushed to different heights relative to the color substrate 20 so as to control the intensity of light emerging from the electro-phoretic layer 33 in individual area. As a result, different colors and different grey levels are displayed.

Please refer to FIG. 3A to FIG. 3D, FIG. 3A to FIG. 3D illustrate a driving method of the driver according to an embodiment of the present invention. In the embodiment, the first color resist R is a color resist for display, and the second, the third, and the fourth color resists G, B, W are color resists not for display. That means, red color corresponding to the first color resist R is the color for display, and green color, blue color, and white color corresponding to the second, the third, and the fourth color resists G, B, W are not the color for display.

Figure 3A:
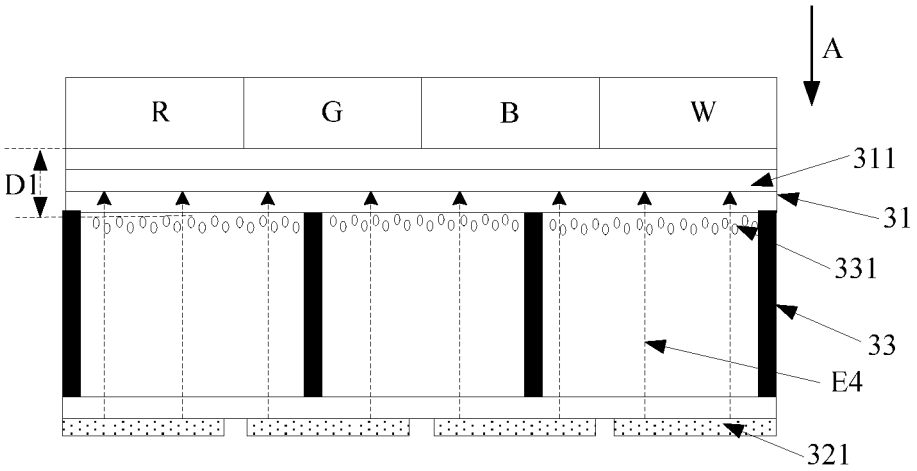
FIG. 3A to FIG. 3D is a schematic diagram showing positions of reflective particles under different electric fields generated by a driving method according the present invention.

Please refer to FIG. 3A, the driver provides a voltage V1 to the common electrode 311. V1 is, for example, 8 volts. The driver also provides a voltage V2 to all of the pixel electrodes 321. V2 is, for example, 10 volts. Therefore, a fourth electric field E4 directed opposite to the direction A is formed in the electro-phoretic layer 33. The reflective particles 331 in the electro-phoretic layer 33 move toward the first substrate 31 under the influence of the fourth electric field E4 until finally reach to a point having a first distance D1 from the color substrate 20. For example, the reflective particles 331 may move until attach to an inner side of the first substrate 31. Specifically, the magnitude of the first distance D1 can be flexibly adjusted according to the grey level expected to be displayed. It's enough once the light entering into the electro-phoretic layer 33 will emerge from the electro-phoretic layer 33 after being reflected by the reflecting particles.

Figure 3B:
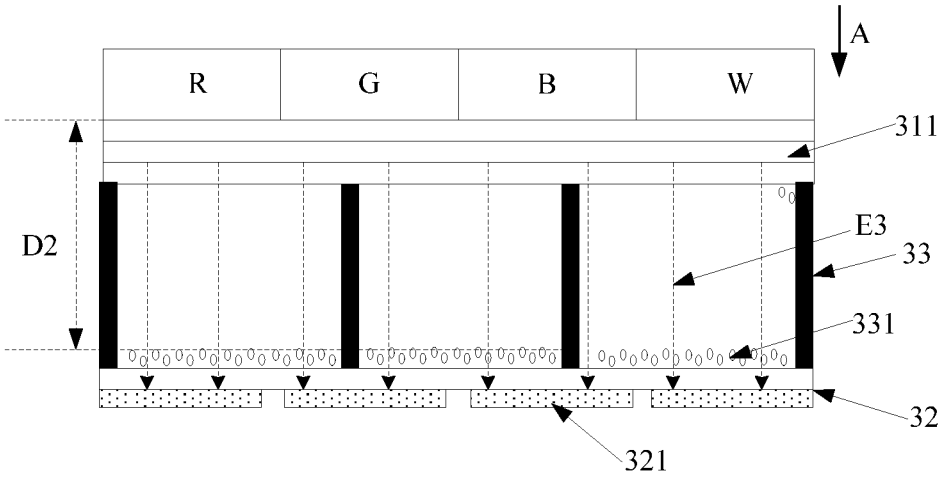

Please refer to FIG. 3B, the driver maintains the voltage V1 (8 volts) of the common electrode 311 unchanged. At the same time, the driver provides a voltage V3 to all of the pixel electrodes 321. V3 is, for example, 5 volts. Hence, a third electric field E3 directed along the direction A is formed in the electro-phoretic layer 33. The reflective particles 331 in the electro-phoretic layer 33 move toward the second substrate 32 under the influence of the third electric field E3 until finally reach to a point having a second distance D2 from the color substrate 20. For example, the reflective particles 331 may move until attach to the inner side of the second substrate 32.

Figure 3C:
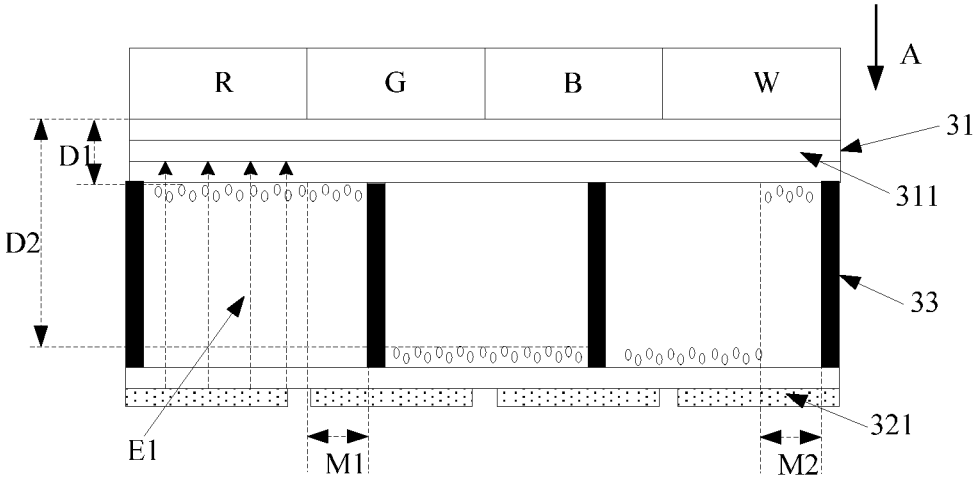

Please refer to FIG. 3C, the driver maintains the voltage V1 (8 volts) of the common electrode 311 unchanged. At the same time, the driver provides the voltage V2 (10 volts) to the pixel electrode corresponding to the first color resist R, and the voltage V1 (8 volts) to the pixel electrodes corresponding to the second, the third, and the fourth color resists G, B, W. Therefore, a first electric field E1 directed opposite to the direction A is formed in the area corresponding to the first color resist R. The first electric field E1 pushes the reflective particles in the area corresponding to the first color resist R toward the first substrate 31 until finally reach to the point having the first distance D1 from the color substrate 20. There is no electric field in the area corresponding to the second, the third, and the fourth color resists G, B, W. However, the existence of the first electric field E1 will affect areas M1 and M2. The area $M_1$ is located in the area corresponding to the second color resist G and next to the area corresponding to the first color resist R. The area $M_2$ is located in the area corresponding to the fourth color resist W and next to the area corresponding to the first color resist R. The first electric field E1 will push the reflective particles in the areas $M_1$ and $M_2$ toward the first substrate 31 until finally reach to the point having the first distance D1 from the color substrate 20.

Figure 3D:
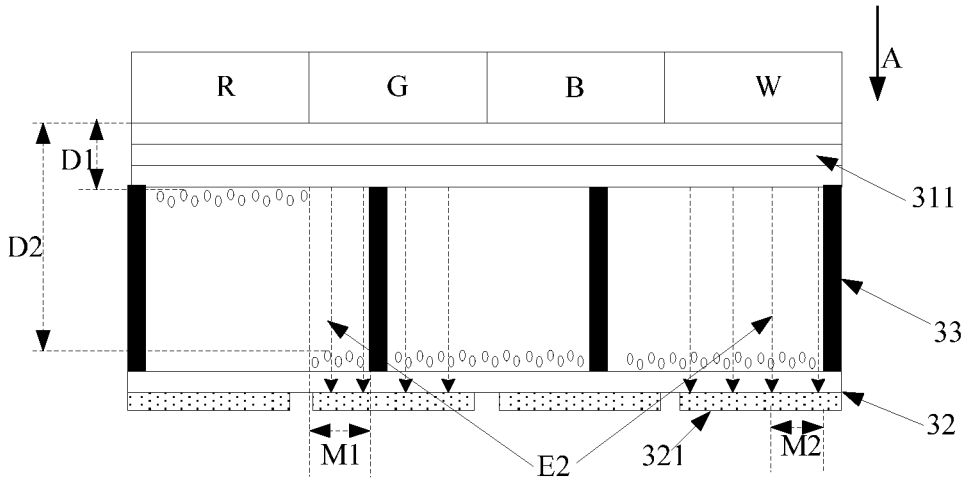

Please refer to FIG. 3D, the driver maintains the voltage V1 (8 volts) of the common electrode 311 unchanged. At the same time, the driver provides the voltage V3 (5 volts) to the pixel electrodes corresponding to the second and the fourth color resists G, W, and provides the voltage V1 (8 volts) to the pixel electrode corresponding to the first color resist R. Thus, a second electric field E2 directed along the direction A is formed in each of the areas corresponding to the second and the fourth color resists G, W. The second electric fields E2 push the reflective particles in the electro-phoretic layer 33 in the areas M1 and M2 toward the second substrate 32 until finally reach to the point having the second distance D2 from the color substrate 20. For example, the reflective particles may move until attach to the inner side of the second substrate 32.

After being driven in this manner, the reflective particles in the electro-phoretic layer 33 in the area corresponding to the first color resist R have the distance D1 from the color substrate 20. The reflective particles in the area corresponding to the second, the third, and the fourth color resists G, B, W have the distance D2 from the color substrate 20. Especially, the reflective particles in the electro-phoretic layer 33 in the areas M1 and M2 have the distance D2 from the color substrate 20. When the distance from the color substrate 20 is the first distance D1, light incident into the area corresponding to the first color resist R will be partly or completely directed to the reflective particles in that area. After being reflected by the reflective particles in that area, light will partly or completely emerge from the electro-phoretic layer 33 to display red color corresponding to the first color resist R. When the distance from the color substrate 20 is the second distance D2, light incident into the area corresponding to the second, the third, and the fourth color resists G, B, W will be absorbed by the light absorbing liquid in the electro-phoretic layer 33. The absorption will occur either before it is directed to the reflective particles in that area, or after it is reflected by the reflective particles in that area but before it emerges from the electro-phoretic layer 33.

Since the reflective particles in the areas M1 and M2 have the distance D2 from the color substrate 20, light incident into the areas M1 and M2 will be absorbed by the light absorbing liquid in the electro-phoretic layer 33. It will not emerge from the electro-phoretic layer 33. Hence, the display of the color corresponding to the first color resist R will not be affected. As a result, the display quality is improved.

Figure 4A:
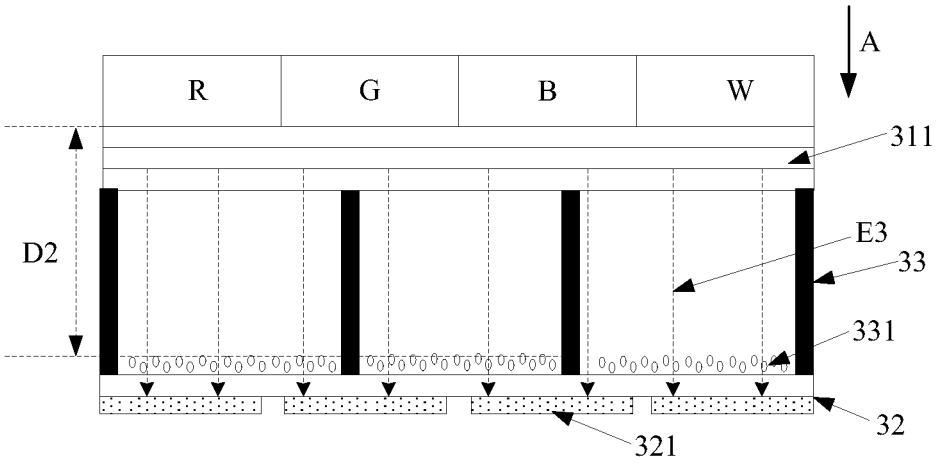
FIG. 4A to FIG. 4C is a schematic diagram showing positions of reflective particles under different electric fields generated by another driving method according the present invention.
Figure 4B:
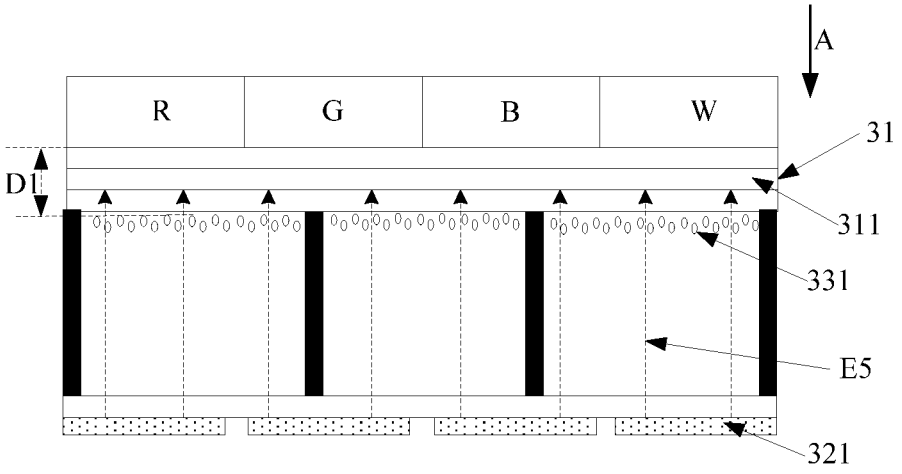
Figure 4C:
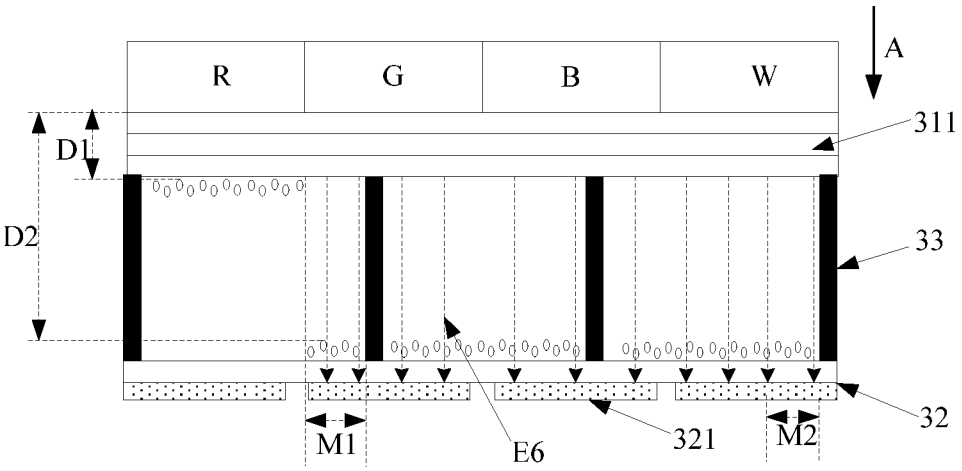

Please refer to FIG. 4A to FIG. 4C, FIG. 4A to FIG. 4C illustrate another driving method of the driver according to an embodiment of the present invention.

Please refer to FIG. 4A, the driver provides the voltage V1 (8 volts) to the common electrode 311, and provides the voltage V3 (5 volts) to all of the pixel electrodes 321. Hence, the third electric field E3 directed along the direction A is formed in the electro-phoretic layer 33. The reflective particles 331 in the electro-phoretic layer 33 move toward the second substrate 32 under the influence of the third electric field E3 until finally reach to the point having the second distance D2 from the color substrate 20. For example, the reflective particles 331 may move until attach to the inner side of the second substrate 32.

Please refer to FIG. 4B, the driver maintains the voltage V1 (8 volts) of the common electrode 311 unchanged. The driver also provides the voltage V2 (10 volts) to all of the pixel electrodes 321. Therefore, a first electric field E5 directed opposite to the direction A is formed in the electro-phoretic layer 33. The reflective particles 331 in the electro-phoretic layer 33 move toward the first substrate 31 under the influence of the first electric field E5 until finally reach to the point having the first distance D1 from the color substrate 20. For example, the reflective particles 331 may move until attach to the inner side of the first substrate 31.

Please refer to FIG. 4C, the driver maintains the voltage V1 (8 volts) of the common electrode 311 unchanged. At the same time, the driver provides the voltage V3 (5 volts) to the pixel electrodes corresponding to the second, the third, and the fourth color resists G, B, W, and provides the voltage V1 (8 volts) to the pixel electrode corresponding to the first color resist R. Thus, a second electric field E6 directed to the direction A is formed in the area corresponding to the second, the third, and the fourth color resists G, B, W. The second electric field E6 pushes the reflective particles in the area corresponding to the second, the third, and the fourth color resists G, B, W toward the second substrate 32 until finally reach to the point having the second distance D2 from the color substrate 20. For example, the reflective particles may move until attach to the inner side of the second substrate 32.

After being driven in this manner, the reflective particles in the electro-phoretic layer 33 in the area corresponding to the first color resist R have the distance D1 from the color substrate 20. The reflective particles in the area corresponding to the second, the third, and the fourth color resists G, B, W have the distance D2 from the color substrate 20. Especially, the reflective particles in the electro-phoretic layer 33 in the areas M1 and M2 have the distance D2 from the color substrate 20. When the distance from the color substrate 20 is the first distance D1, light incident into the area corresponding to the first color resist R will be partly or completely directed to the reflective particles in that area. After being reflected by the reflective particles in that area, light will partly or completely emerge from the electro-phoretic layer 33 to display red color corresponding to the first color resist R. When the distance from the color substrate 20 is the second distance D2, light incident into the area corresponding to the second, the third, and the fourth color resists G, B, W will be absorbed by the light absorbing liquid in the electro-phoretic layer 33. The absorption will occur either before it is directed to the reflective particles in that area, or after it is reflected by the reflective particles in that area but before it emerges from the electro-phoretic layer 33.

Since the reflective particles in the areas M1 and M2 have the distance D2 from the color substrate 20, light incident into the areas M1 and M2 will be absorbed by the light absorbing liquid in the electro-phoretic layer 33. It will not emerge from the electro-phoretic layer 33. Hence, the display of the color corresponding to the first color resist R will not be affected. As a result, the display quality is improved.

Figure 5:
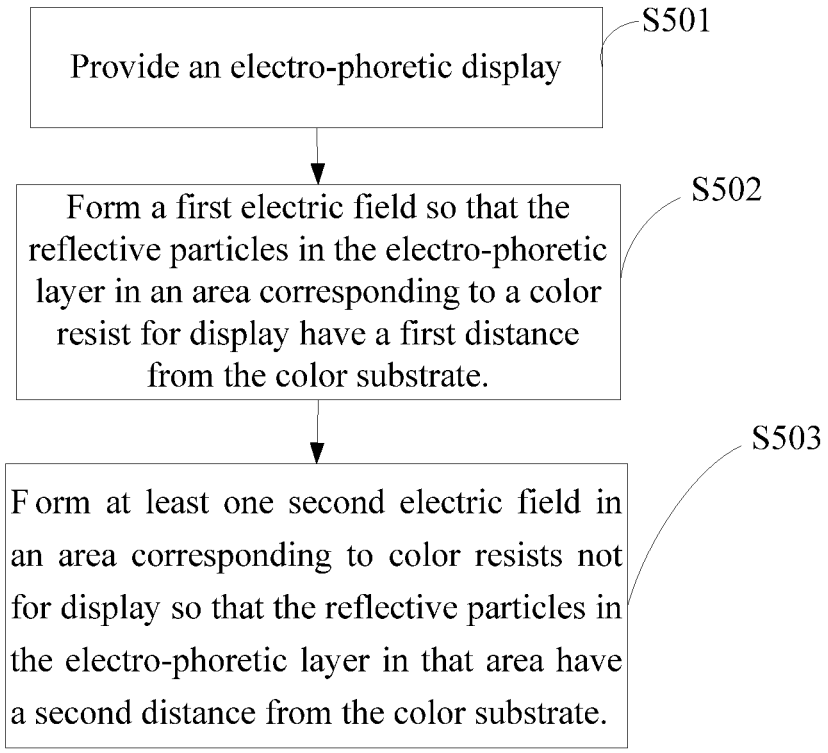
FIG. 5 is a schematic diagram showing a flow of a display method of the present invention electro-phoretic display according to a preferred embodiment of the present invention.

Please refer to FIG. 5, FIG. 5 is a schematic diagram showing a flow of a display method of the present invention electro-phoretic display according to a preferred embodiment of the present invention.

Step 501: provide an electro-phoretic display. The electro-phoretic display sequentially comprises a color substrate and an electro-phoretic layer along a direction of incident light. The color substrate comprises a plurality of color resists. The electro-phoretic layer comprises light absorption liquid and reflective particles, please refer specifically to FIG. 2.

Step 502: form a first electric field so that the reflective particles in the electro-phoretic layer in an area corresponding to a color resist for display have a first distance from the color substrate.

Step 503: form at least one second electric field in an area corresponding to color resists not for display so that the reflective particles in the electro-phoretic layer in that area have a second distance from the color substrate.

The color resist for display is the color resist used for displaying the color intended to be displayed by the electro-phoretic display, for example, the red color resist. When the distance from the color substrate is the first distance, light incident into the area corresponding to the color resist for display will be partly or completely directed to the reflective particles. After being reflected by the reflective particles, light will partly or completely emerge from the electro-phoretic layer to display the color corresponding to the color resist for display. When the distance from the color substrate is the second distance, light incident into the area corresponding to the color resists not for display will be absorbed by the light absorbing liquid in the electro-phoretic layer and no color will be displayed. The absorption will occur either before it is directed to the reflective particles, or after it is reflected by the reflective particles but before it emerges from the electro-phoretic layer.

Specifically, the first electric field can be formed according to two methods:

First: form the first electric field in the area corresponding to the color resist for display.

Second: form the first electric field in the areas corresponding to both the color resist for display and the color resists not for display.

In the first method, prior to forming the first electric field in the area corresponding to the color resist for display, a third electric field is formed in the areas corresponding to both the color resist for display and the color resists not for display. By doing this, the reflective particles in those areas will have the second distance from the color substrate.

Moreover, prior to forming the third electric field in the areas corresponding to both the color resist for display and the color resists not for display, a fourth electric field is formed in the areas corresponding to both the color resist for display and the color resists not for display. By doing this, the reflective particles in those areas will have the first distance from the color substrate.

For the schematic diagram showing the flow of the display method of the present invention electro-phoretic display according to the preferred embodiment, please also refer to the detail description of the electro-phoretic display stated before. Further description is not elaborated here.

The present invention first provides the first electric field to push the reflective particles corresponding to the color resist for display until finally reach to the point having the first distance from the color substrate. Light incident to the reflective particles will be reflected by the reflective particles, and partly or completely emerges from the electro-phoretic layer. Later, at least one second electric field is provided to push the reflective particles corresponding to the color resists not for display until finally reach to the point having the second distance from the color substrate. Consequently, light will be absorbed by the light absorbing liquid in the electro-phoretic layer. Apparently, the present invention prevents the reflective particles from staying in both side areas of the area corresponding to the color resists not for display. As a result, the effects of color display and the display quality are ensured.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A display method for an electro-phoretic display comprising the steps of:

providing the electro-phoretic display; wherein the electro-phoretic display sequentially comprises a color substrate and a switch array substrate along a direction of incident light, the switch array substrate comprises a first substrate, a second substrate, and an electro-phoretic layer sandwiched between the first substrate and the second substrate; the color substrate comprises a plurality of color resists, the electro-phoretic layer comprises light absorption liquid and reflective particles;

forming a first electric field in the areas corresponding to both the color resist for display and the color resists not for display, so that the reflective particles in the electro-phoretic layer in an area corresponding to the color resist for display have a first distance from the color substrate, light incident to the reflective particles partly or completely emerging from the electro-phoretic layer after being reflected by the reflective particles when the distance from the color substrate being the first distance;

after forming the first electric field in the areas corresponding to both the color resist for display and the color resists not for display, forming at least one second electric field in an area corresponding to the color resists not for display so that the reflective particles in the electro-phoretic layer in the area corresponding to the color resists not for display have a second distance from the color substrate, light incident into the electro-phoretic layer being absorbed by the light absorbing liquid when the distance from the color substrate being the second distance;

wherein the color resist for display is the color resist used for displaying a color intended to be displayed by the electro-phoretic display.

2. The display method for the electro-phoretic display as claimed in claim 1, wherein before the first electric field is formed in the area corresponding to the color resist for display the method further comprises the step of:

forming a third electric field in the areas corresponding to both the color resist for display and the color resists not for display so that the reflective particles in those areas have the second distance from the color substrate.

3. The display method for the electro-phoretic display as claimed in claim 2, wherein before the third electric field is formed in the areas corresponding to both the color resist for display and the color resists not for display the method further comprises the step of:

forming a fourth electric field in the areas corresponding to both the color resist for display and the color resists not for display so that the reflective particles in those areas have the first distance from the color substrate.

4. A display method for an electro-phoretic display comprising the steps of:

providing the electro-phoretic display; wherein the electro-phoretic display sequentially comprises a color substrate and an electro-phoretic layer along a direction of incident light, the color substrate comprises a plurality of color resists, the electro-phoretic layer comprises light absorption liquid and reflective particles;

forming a first electric field in the areas corresponding to both the color resist for display and the color resists not for display, so that the reflective particles in the electro-phoretic layer in an area corresponding to the color resist for display have a first distance from the color substrate, light incident to the reflective particles partly or completely emerging from the electro-phoretic layer after being reflected by the reflective particles when the distance from the color substrate being the first distance; and after forming the first electric field in the areas corresponding to both the color resist for display and the color resists not for display, forming at least one second electric field in an area corresponding to the color resists not for display so that the reflective particles in the electro-phoretic layer in the area corresponding to the color resists not for display have a second distance from the color substrate, light incident into the electro-phoretic layer being absorbed by the light absorbing liquid when the distance from the color substrate being the second distance;

wherein the color resist for display is the color resist used for displaying a color intended to be displayed by the electro-phoretic display.

5. The display method for the electro-phoretic display as claimed in claim 4, wherein before the first electric field is formed in the area corresponding to the color resist for display the method further comprises the step of:

forming a third electric field in the areas corresponding to both the color resist for display and the color resists not for display so that the reflective particles in those areas have the second distance from the color substrate.

6. The display method for the electro-phoretic display as claimed in claim 5, wherein before the third electric field is formed in the areas corresponding to both the color resist for display and the color resists not for display the method further comprises the step of:

forming a fourth electric field in the areas corresponding to both the color resist for display and the color resists not for display so that the reflective particles in those areas have the first distance from the color substrate.

7. An electro-phoretic display comprising:

a color substrate having a plurality of color resists;

an electro-phoretic layer comprising light absorption liquid and reflective particles;

an electric field apparatus used for generating a first electric field in the areas corresponding to both the color resist for display and the color resists not for display, so that the reflective particles in the electro-phoretic layer in an area corresponding to a color resist for display have a first distance from the color substrate, and the electric field apparatus used for generating at least one second electric field in an area corresponding to color resists not for display so that the reflective particles in the electro-phoretic layer in the area corresponding to the color resists not for display have a second distance from the color substrate after generating the first electric field in the areas corresponding to both the color resist for display and the color resists not for display;

wherein the color resist for display is the color resist used for displaying a color intended to be displayed by the electro-phoretic display, light incident to the reflective particles partly or completely emerge from the electro-phoretic layer after being reflected by the reflective particles when the distance from the color substrate is the first distance, and light is absorbed by the light absorbing liquid in the electro-phoretic layer when the distance from the color substrate is the second distance.

8. The electro-phoretic display as claimed in claim 7, wherein the electro-phoretic display further comprises a switch array substrate, the switch array substrate comprises a first substrate and a second substrate, and the electro-phoretic layer is disposed between the first substrate and the second substrate;

the electric field apparatus comprises a common electrode and a plurality of pixel electrodes, the common electrode is disposed on the first substrate, and the pixel electrodes are disposed on the second substrate.

9. The electro-phoretic display as claimed in claim 7, further comprising a driver electrically connected the common electrode and the pixel electrodes.

10. The electro-phoretic display as claimed in claim 7, wherein the light absorption liquid is black liquid, and the reflective particles are white reflective particles.

* * * * *